US007094183B2

(12) United States Patent
Hsieh

(10) Patent No.: US 7,094,183 B2
(45) Date of Patent: Aug. 22, 2006

(54) MULTI-PURPOSE SURFING BALANCER

(76) Inventor: Jung-Pao Hsieh, No. 64, Lane 289, Geen Yuan Rd. Chungli City, Taoyuan Hsien (TW)

( * ) Notice: Subject to any disclaimer, the term of this patent is extended or adjusted under 35 U.S.C. 154(b) by 284 days.

(21) Appl. No.: 10/342,184

(22) Filed: Jan. 15, 2003

(65) Prior Publication Data

US 2004/0138028 A1 Jul. 15, 2004

(51) Int. Cl.
*A63B 71/00* (2006.01)

(52) U.S. Cl. ..... 482/51; 482/123; 482/146

(58) Field of Classification Search ..... 482/51, 482/123, 127, 130, 142, 146, 147, 148
See application file for complete search history.

(56) References Cited

U.S. PATENT DOCUMENTS 5,062,629 A * 11/1991 Vaughan ..... 482/51
6,413,197 B1 * 7/2002 McKechnie et al. ..... 482/146
6,676,579 B1 * 1/2004 Lin ..... 482/146
6,692,419 B1 * 2/2004 Chen ..... 482/146
2002/0177511 A1 * 11/2002 Jang
2003/0032533 A1 * 2/2003 Hecox et al.
2004/0023766 A1 * 2/2004 Slone

* cited by examiner

*Primary Examiner*—Gregory L. Huson
*Assistant Examiner*—Tam Nguyen
(74) *Attorney, Agent, or Firm*—Troxell Law Office, PLLC

(57) ABSTRACT

A multi-purpose surfing balancer including a base plate, a resilient rubber body, a step-on board, and a central pole. A bottom surface of the rubber body being fixed to a middle of a top of the base plate. The top of the base plate being fixed to a middle of a bottom of the step-on board. The central pole being fixed to the surface of the step-on board for a user to stand on the step-on board with both feet splitting over both ends of the resilient rubber body in position to practice balancing or surfing by the support of the resilient rubber body and swing motion controlled by the user.

5 Claims, 11 Drawing Sheets

MULTI-PURPOSE SURFING BALANCER

BACKGROUND OF THE INVENTION (a) Field of the Invention

The present invention is related to a multi-purpose surfing balancer, and more particularly, to one that allows its user to practice balancing and thus to work out in the excitement of surfing by standing on a step-on board fixed to a rubber body below.

(b) Description of the Prior Art

Many types of fitness equipment are available in the market as more and more people are eager to work out for staying fit. As far as a balancer is concerned, a balancing board (A) as illustrated in FIG. 1 of the accompanying drawings is generally available in the market. The balancing board is comprised of having a set of rollers (A2) fixed to the bottom of a board (A1) in the center for a user to stand on the board (A1) to practice balancing while amusing him/herself. However, potential risk to get hurt exists while the user is trying to step on or off the board (A1) as the rollers may slide.

As illustrated in FIGS. 2 and 3, another prior art disclosed in ROC Patent Gazette No. 435242 teaches that a balance training equipment is comprised of a handlebar pole (A2') fixed to the front end of a base (A1'). A balancing unit (A3') comprised of a coil (A32') sandwiched between a top plate (A 31') and a bottom plate (A 33') is connected t the base (A1') A bearing (A34') is each provided at an axle block at where the base plate (A33') and the base (A1') rest upon. The top plate (A31') allows the user to stand upon it and swing to both extremes for balance training. However, the prior art involves complicate assembly and higher production cost to fail its economic benefits. Besides, it serves only for balancing purpose and is prevented from adjustment of the resilience as required by the individual user.

SUMMARY OF THE INVENTION

The primary purpose of the present invention is to provide a multi-purpose surfing balancer comprised of a base plate, a resilient rubber body, a step-on board and a handlebar pole. Wherein, the resilient rubber body has it bottom fixed to where at the middle of the top surface of the base plate and the pole has its bottom provided with a pin to inserted through a hole provided on the surface of the step-on board. The user stands on the step-on board with both feet splitting over both ends of the resilient rubber body to achieve workout of his/her whole body by balancing through controlled swing when stepping on both ends of the resilient rubber and supported by the resilient rubber or by holding a handlebar to circle around the resilient rubber body.

Another purpose of the present invention is to provide a multi-purpose surfing balancer that have provided multiple grains on the step-on board to massage both feet of the user while standing upon the step-on board to work out.

Another purpose yet of the present invention is to provide a multi-purpose surfing balancer that has provided a cover plate on the step-on board at where in relation to a through hole in the resilient rubber body to cover up an additional resilient rod in the through hole as an option for multiple resilience as preferred by the user.

DETAILED DESCRIPTION OF THE PREFERRED EMBODIMENTS

Figure 1:
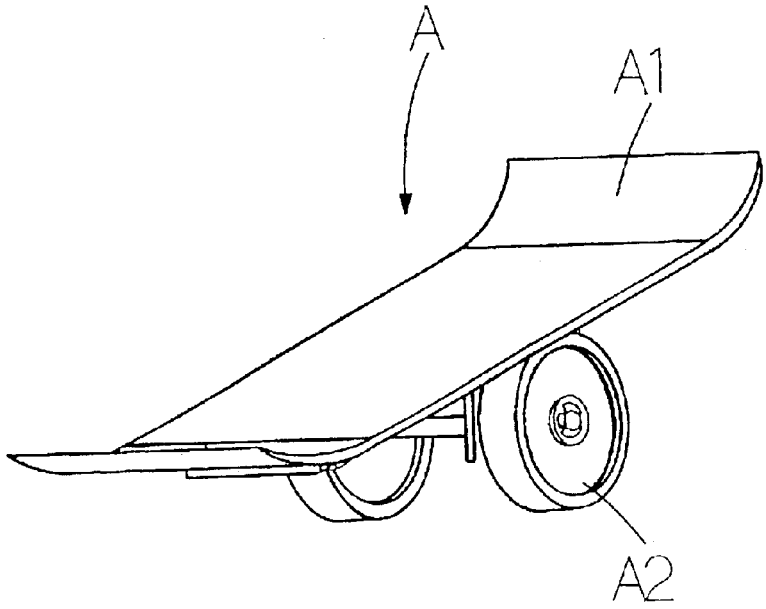
FIG.1 Prior Art
FIG. 1 is a perspective view of a balancer of the prior art.
Figure 2:
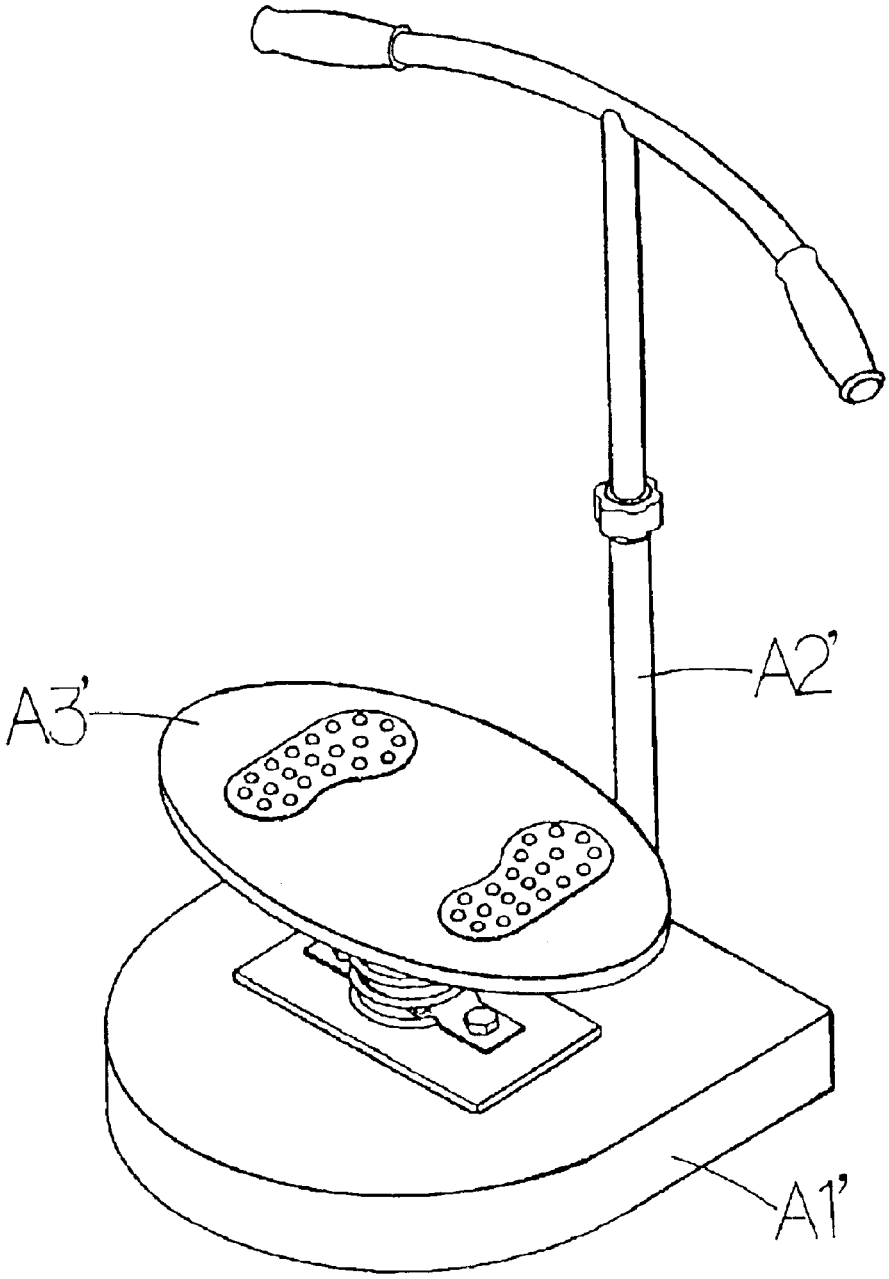
FIG.2 Prior Art
FIG. 2 is a perspective view of another balancer of the prior art.
Figure 3:
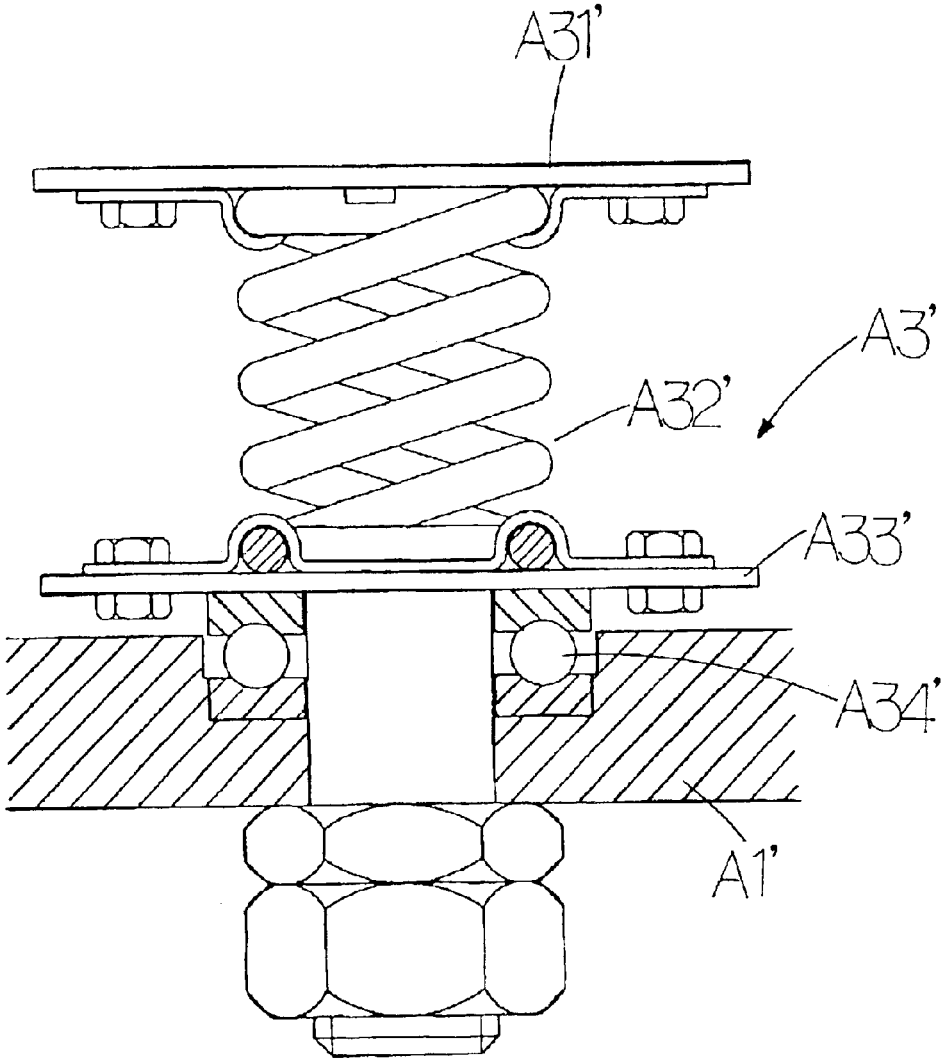
FIG.3 Prior Art
FIG. 3 is a schematic view showing an assembly of the balancer of the prior art.
Figure 4:
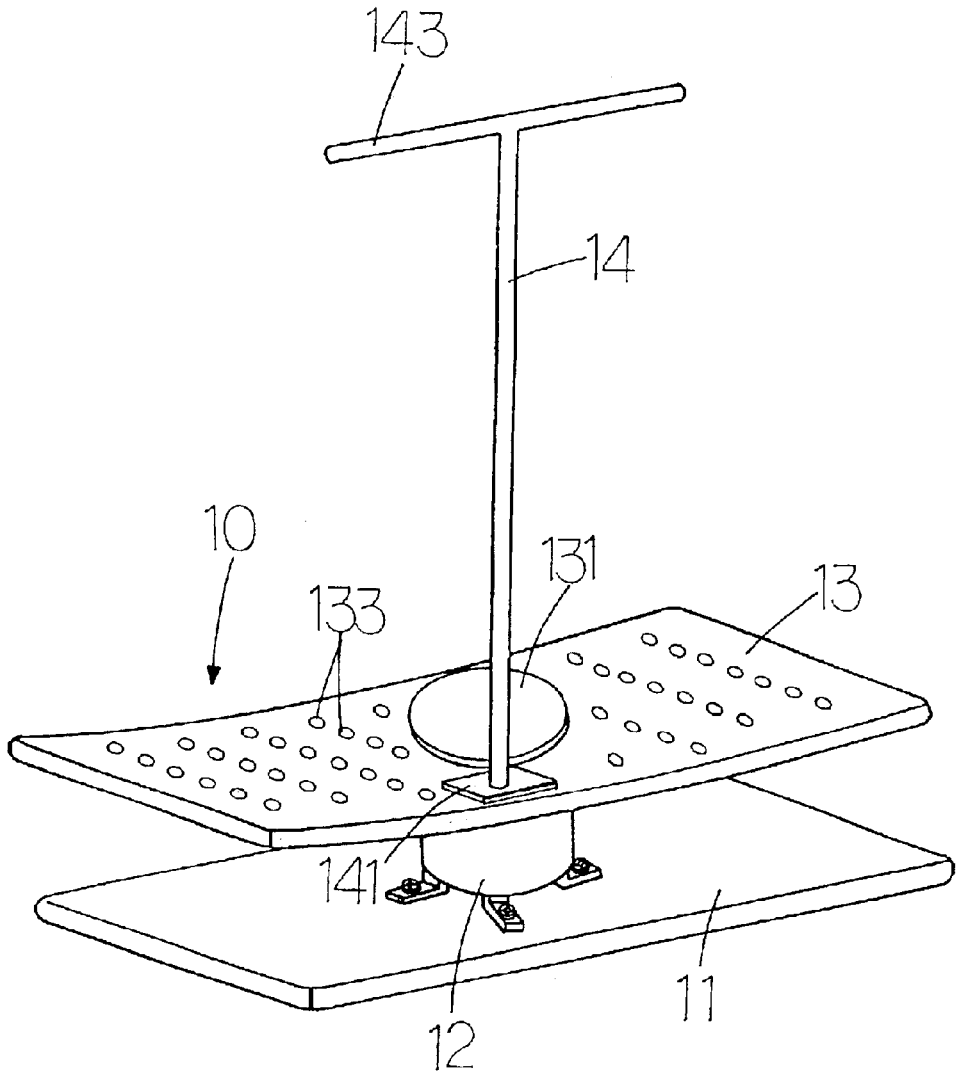
FIG. 4 is a view showing the appearance of a surfing balancer of the present invention.
Figure 5:
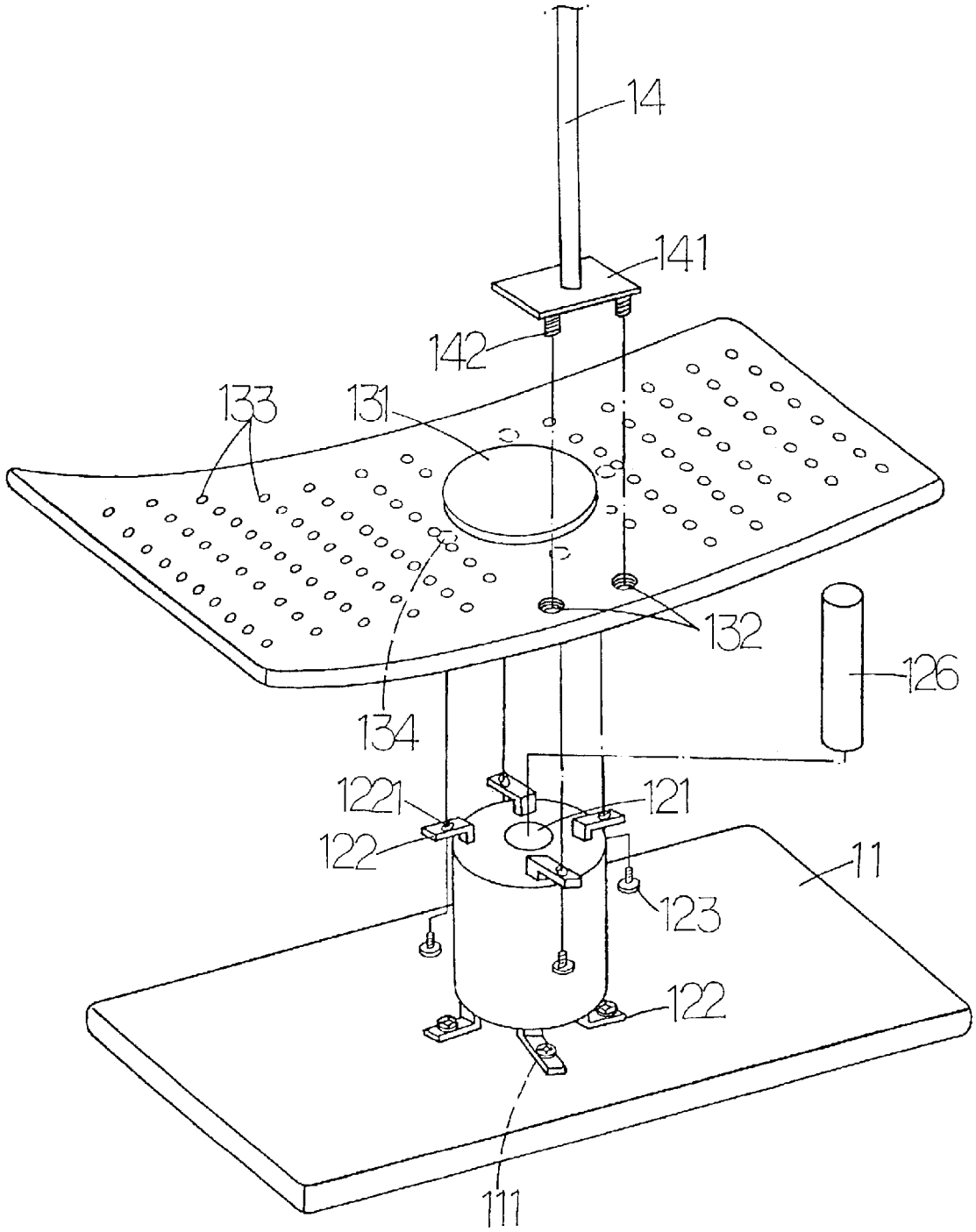
FIG. 5 is an exploded view of the present invention.

Referring to FIGS. 4 and 5, a multi-purpose surfing balancer (10) of a preferred embodiment of the present invention is essentially comprised of a base plate (11), a resilient rubber body (12), a step-on board (13), and a handlebar pole (14). Wherein the base plate (11) in a given thickness, has at the middle of its top surface connected with a resilient rubber body (12). The resilient rubber body (12) has its bottom fixed to where at the middle of the top of the base plate (11) and its top fixed to where at the middle of the bottom of the step-on board. A through hole (121) is provided in the center of the resilient rubber body (12) and both of the upper and the lower edges of the resilient rubber body (12) are each lined with an iron sheet to increase its strength. A cover plate (131) is provided to the step-on board (13) at where in relation to the through hole (121) in the resilient rubber body (12) and multiple holes (132) are provided on the step-on board (13). The top of the step-on board (13) is provided with multiple grains (133) for massage purpose. The handlebar pole (14) has at its lower end connected to a square plate (141) whereon a pin (142) is provided to be inserted into the through hole (132) in the step-on board, and has a handlebar (143) provided laterally on the top of the handlebar pole (14). Note: the handlebar pole and it's corresponding connection means are not shown in FIGS. 6, 7 and 9–11 to simplify the drawings. Multiple fixation plates (122) are provided on both of the upper and the lower edges of the resilient rubber body, and each fixation plate (122) is bored with a screw hole (1221) and a matching hole (111, 134) is each respectively provided on the top of the base plate (11) and the bottom of the step-on board (13) to be inserted with a bolt (123) to secure the resilient rubber body (12) between the step-on board (13) and the base plate (11). The pin (142) of the handlebar pole (14) is then inserted into the through hole (132) of the step-on board (13) to complete the assembly of the preferred embodiment of the present invention.

Figure 6:
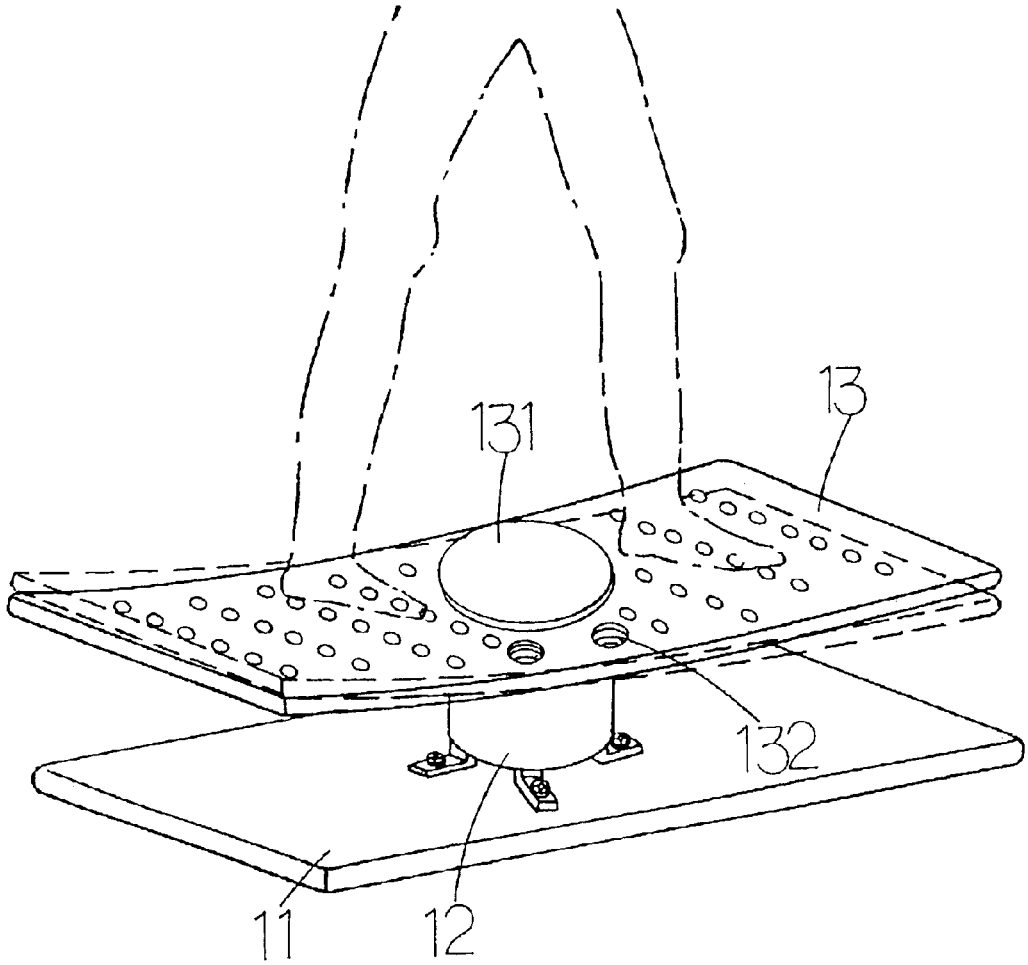
FIG. 6 is a schematic view showing that the present invention is in use.
Figure 7:
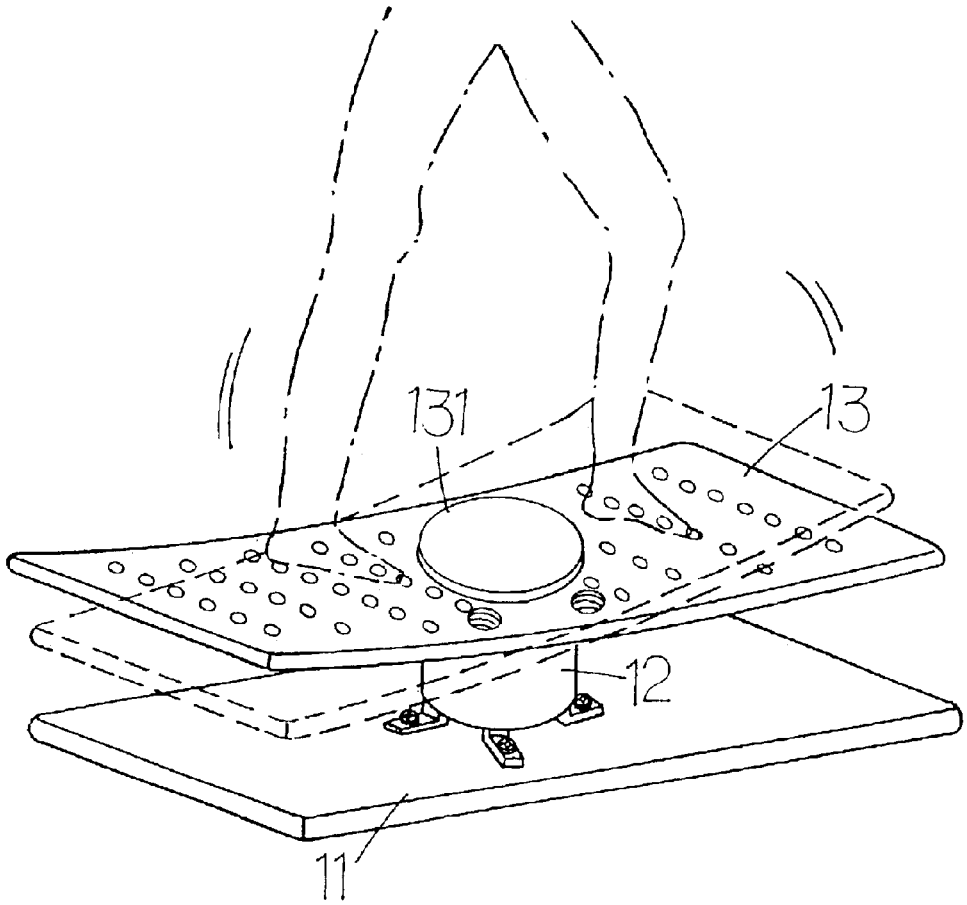
FIG. 7 is a schematic view showing another use of the present invention.
Figure 8:
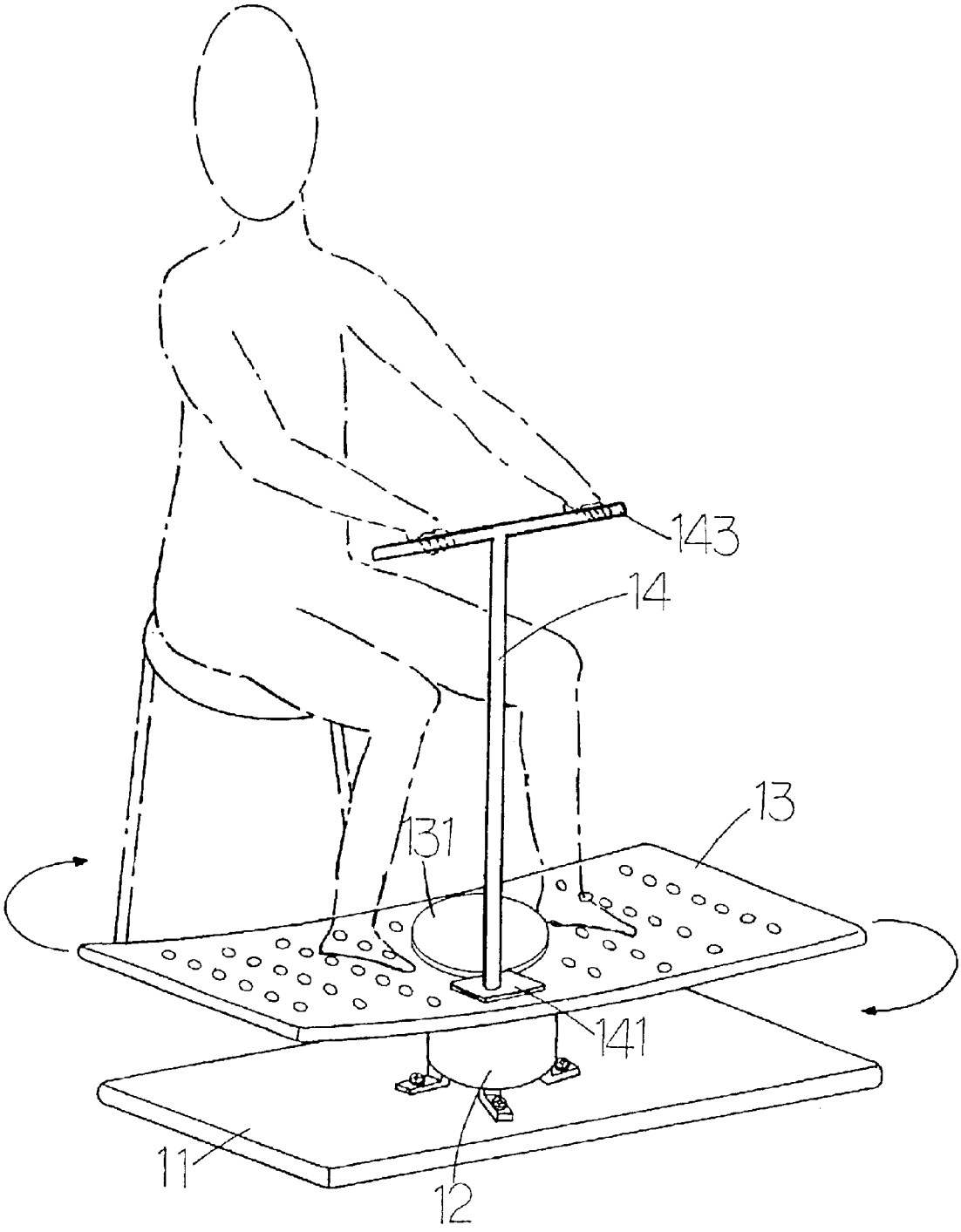
FIG. 8 is a schematic view showing another use yet of the present invention.
Figure 9:
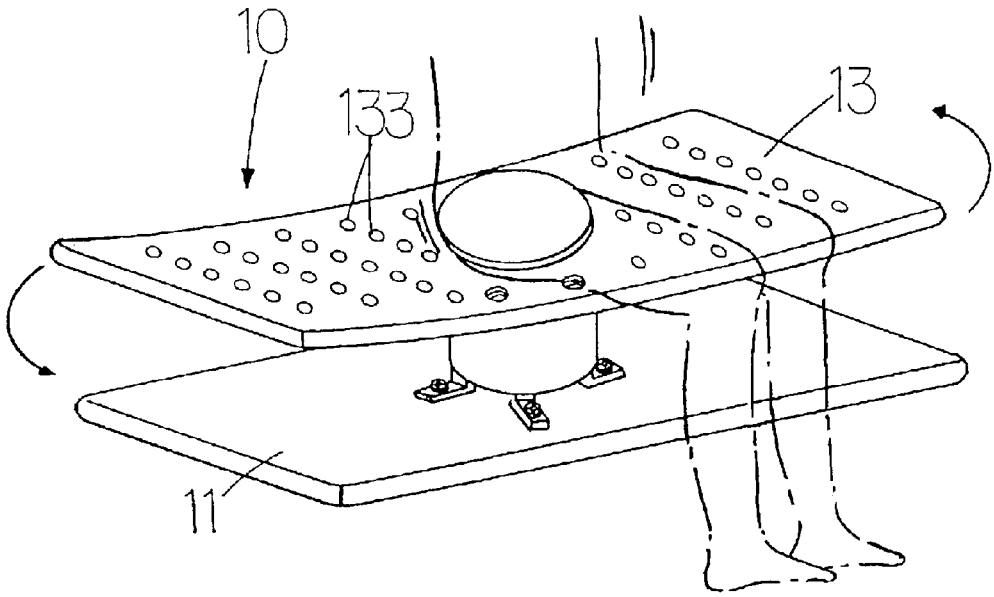
FIG. 9 is a schematic view showing another use yet of the present invention.
Figure 10:
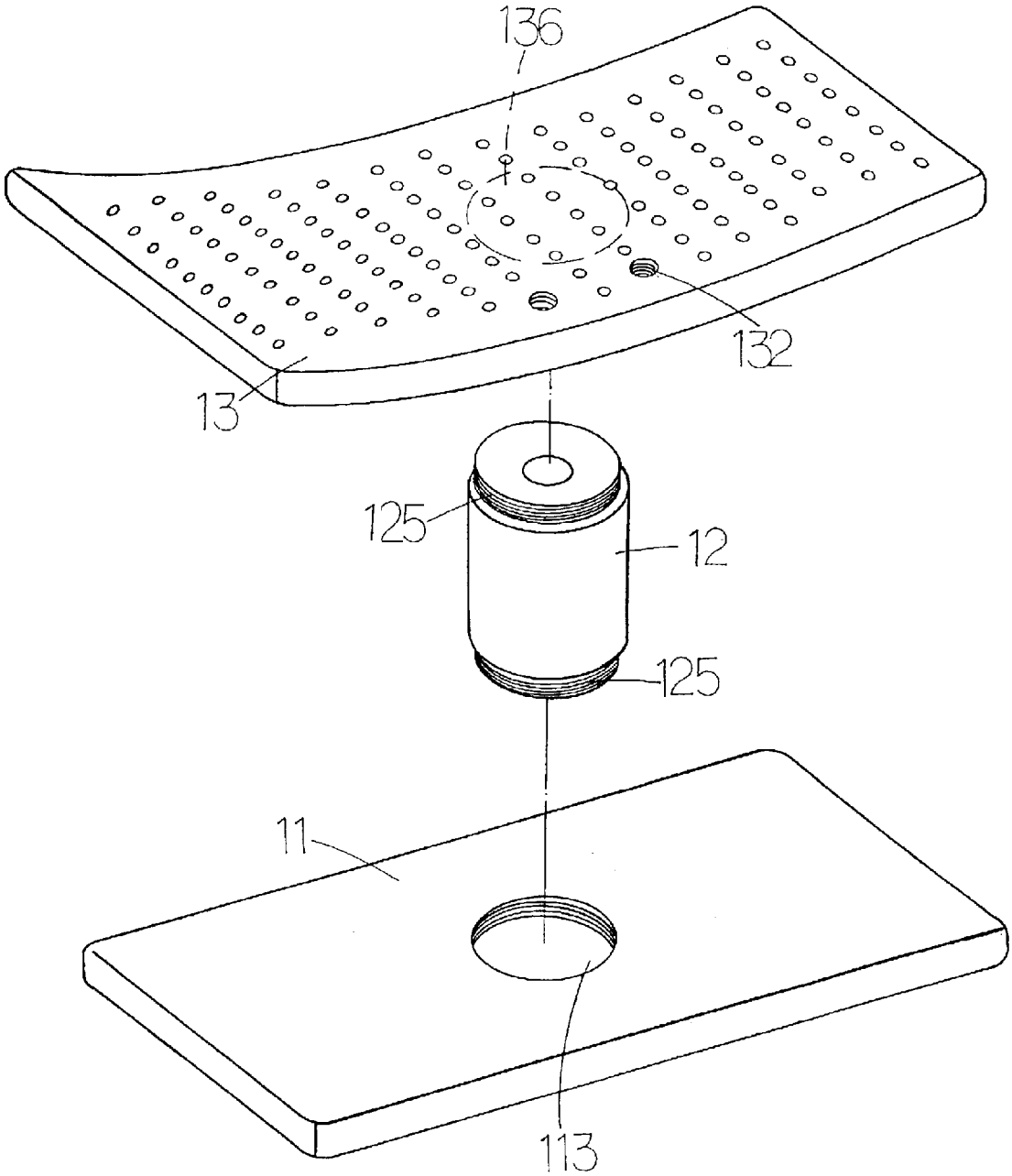
FIG. 10 is another exploded view of the present invention.

As illustrated in FIG. 6, a user having his/her both feet stepping on the step-on board (13) and splitting over both ends of the resilient rubber body (12) to practice balancing by slightly swinging his/her body. Once the user exercises swinging at a larger span as illustrated in FIG. 7, he/she is working out with his/her whole body while enjoying the excitement similar to surfing. Or, alternatively, as illustrated in FIG. 8, the user may sit in a chair and has his/her both feet stepping on the step-on board (13) while with his/her hands holding the handlebar (143) of the handlebar pole (14) to exercise around the resilient rubber body (12). Furthermore, as illustrated in FIG. 9, the user may sit on the step-on board (13) to exercise circular motion around the resilient rubber body (12).

Figure 11:
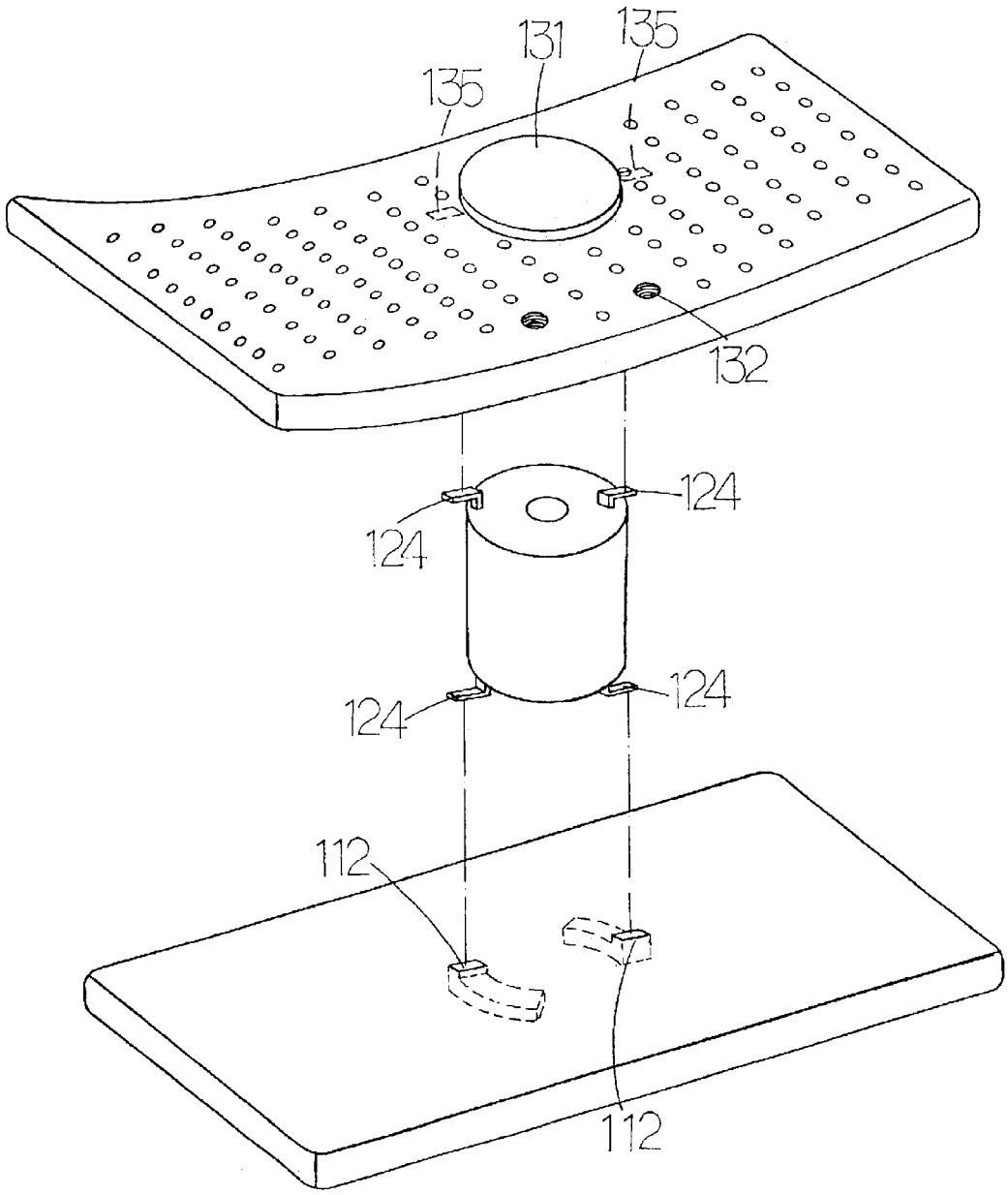
FIG. 11 is another exploded view yet of the present invention.

Now referring to FIG. 11, in an optional means to incorporate the resilient rubber body (12) to the base plate (11) and the step-on board (13), two holes (112) are provided on the base plate (11) and another two holes (not illustrated) are provided on the bottom of the step-on board (13) at where both of the base plate (11) and the step-on board (13) are in relation to their corresponding fixation plates (124) on the lower edges of the resilient rubber body (12); and an arc plane is each extending from one side of those two holes (112) on the surface of the base plate (11), and the same arc plane is each extending from one side of those two holes on the bottom of the step-on board (13) to receive and screw their corresponding fixation plates (124) provided on the upper edge of the resilient rubber body (12) so to hold the resilient rubber body (12) in position. As illustrated in FIG. 11, another means of incorporating the resilient rubber body (12) to the base plate (11) and the step-on board has provided two inner threads (113, 136) respectively through the base plate (11) and the step-on board (13) at where they are in relation to the resilient rubber body (12) to be engaged to those threads (125) respectively provided at the top and the bottom of the resilient rubber body (12) to increase the strength of the resilient rubber body (12). As desired by the user, the resilience of the resilient rubber body (12) may be adjusted by placing a rubber rod (126) into the through hole (121) and covered up by the cover plate (131).

The present invention provides better workout results by allowing the user to stand on the step-on board and split over both ends of the resilient rubber body to swing his/her body for exercising the whole body while enjoying the excitement of surfing, or to sit in a chair or sit on the step-on board to engage circular motion around the resilient rubber body with the resilience of the resilient rubber body adjustable depending on the individual preference. However, it is to be noted that hat the preferred embodiment given in the specification is in no way to limit the present invention, and any structure, installation or characteristics that is similar or equivalent to that of the present invention shall be included within the purposes and claims of the present invention.

I claim:

1. A multi-purpose surfing balancer includes a base plate, a resilient rubber body, a step-on board, and a handlebar pole, wherein, the base plate has a predetermined thickness, the resilient rubber body is connected at a bottom thereof to a middle of a top of the base plate and at a top thereof to a middle of a bottom of the step-on board, a through hole being provided at the center of the resilient rubber body, and a rubber rod being inserted into the through hole; the step-on board having a cover plate aligning with the through hole in the resilient rubber body, multiple holes being provided on the step-on board; and multiple grains for massage purpose being provided on the top of the step-on board; and the handlebar pole having a plate connected to its bottom thereof, multiple pins extending from a bottom of the plate, each of the multiple pins is inserted into one of the multiple holes in the step-on board, and a handlebar being provided on a top of the pole.

2. The multi-purpose surfing balancer as claimed in claim 1, further comprising multiple fixation plates located on the top and the bottom of the resilient rubber body and a screw hole is provided in each of the multiple fixation plates, a bolt is inserted through each screw hole and connected to one of a plurality of fixation holes in the top of the base plate and the bottom of the step-on board to secure the resilient body between the board and the plate.

3. The multi-purpose surfing balancer as claimed in claim 1, wherein, two plate holes are provided on the surface of the base plate and two board holes are provided on the bottom of the step-on board, and an arc plane extending from one side of each of the plate and board holes to receive and secure a corresponding fixation plate provided on the upper and the lower edges of the resilient rubber body.

4. The multi-purpose surfing balancer as claimed in claim 1, wherein, both upper and lower ends of the resilient rubber body have a threaded portion and each of the step-on board and the base plate have a threaded hole connected to the threaded portion of the upper and lower end respectively.

5. The multi-purpose surfing balancer as claimed in claim 1, wherein a resilience of the resilient rubber body is selectively adjusted by removing the rubber rod.

* * * * *